United States Patent [19]

Kato

[11] 4,141,543

[45] Feb. 27, 1979

[54] TOGGLE CLAMP DEVICE

[76] Inventor: Kazuyoshi Kato, 234, Dogashiba-cho, Tennozi-ku, Osaka, Japan

[21] Appl. No.: 750,636

[22] Filed: Dec. 15, 1976

[30] Foreign Application Priority Data

Feb. 12, 1976 [JP] Japan ..... 51-14444

[51] Int. Cl.[2] ..... B25B 1/14

[52] U.S. Cl. ..... 269/228

[58] Field of Search ..... 269/201, 228

[56] References Cited

U.S. PATENT DOCUMENTS

| | | | |
|---|---|---|---|
| 2,699,698 | 1/1955 | Adams | 269/201 |
| 3,735,972 | 5/1973 | Blatt | 269/228 |
| 3,748,936 | 7/1973 | Minasy | 269/228 |

FOREIGN PATENT DOCUMENTS

| | | | |
|---|---|---|---|
| 188089 | 12/1956 | Austria | 269/228 |

*Primary Examiner*—Robert C. Watson

*Attorney, Agent, or Firm*—Burns, Doane, Swecker & Mathis

[57] ABSTRACT

A toggle clamping device for locking workpieces in a fixed position is provided in which the toggle linkage includes two movable pins and a fixed pin which, when in alignment exert the maximum force against the workpieces. Releasable means are provided for locking the toggle linkage in the position of maximum clamping force, even when the thicknesses of the workpieces varies slightly.

7 Claims, 10 Drawing Figures

FRONT
A
B
P
O

TOGGLE CLAMP DEVICE

This invention relates to a manual toggle clamp used for clamping a workpiece on a machine or jig when performing machining work thereon or plate assembly work.

A manual toggle clamp provides various types of toggle joints between a handle and a work pressing member. Generally a toggle joint is so constructed that a first link is pivotally mounted on a fixed pin on a base bracket, a second link is mounted on a first movable pin provided on the first link, a second movable pin is provided on the second link, the first movable pin is connected to a handle and the second movable pin is connected to the work pressing member. Thus the maximum pressing force for clamping the workpiece can be applied to the work pressing member when the fixed pin, the first movable pin, and the second movable pin are positioned on a straight line by changing the position of one movable pin by using the handle. In this case the position of the first movable pin on the handle side is unstable when merely aligning the three pins on the straight line by using the handle. Therefore, a stop is provided between the handle and the bracket or between the links, so that the handle will stop at a position where the first movable pin passes a little beyond the straight line from one side to the other. According to said conventional toggle constructions, however, the first movable pin is devised so as to stop at a position a little beyond a dead point on the straight line. Therefore, the clamping force applied by the work pressing member on the workpiece is considerably lessened as compared with the maximum value of that at the dead point, so that the position on the workpiece might deviate somewhat during machining. When the position of the first movable pin is brought as close as possible to the dead point when clamping the workpiece, the clamping force will increase but is apt to be inadvertently released and thus cause serious troubles such as an error in machining and/or breakage of tools when subjected to vibration or shock. Further, since it is necessary to confirm the maximum clamping by hand feeling and observation when operating conventional toggle clamps, they have had very poor operational efficiency. Moreover, since the first movable pin must pass over the dead point in the reverse direction when unclamping, the disadvantage is unavoidable that a fairly large force is required.

An object of this invention is to enable the movable pin adjacent the handle to automatically stop at the dead point on the straight or neutral line precisely and smoothly, and further to keep that position in order to avoid the above-mentioned disadvantages. The invention will be better understood from the following description taken in connection with the accompanying drawings, in which:

FIG. 1 is a side elevational view of a toggle clamp according to the invention;

FIG. 1*a* is a partially enlarged view of FIG. 1.

Figures 5, 5A:
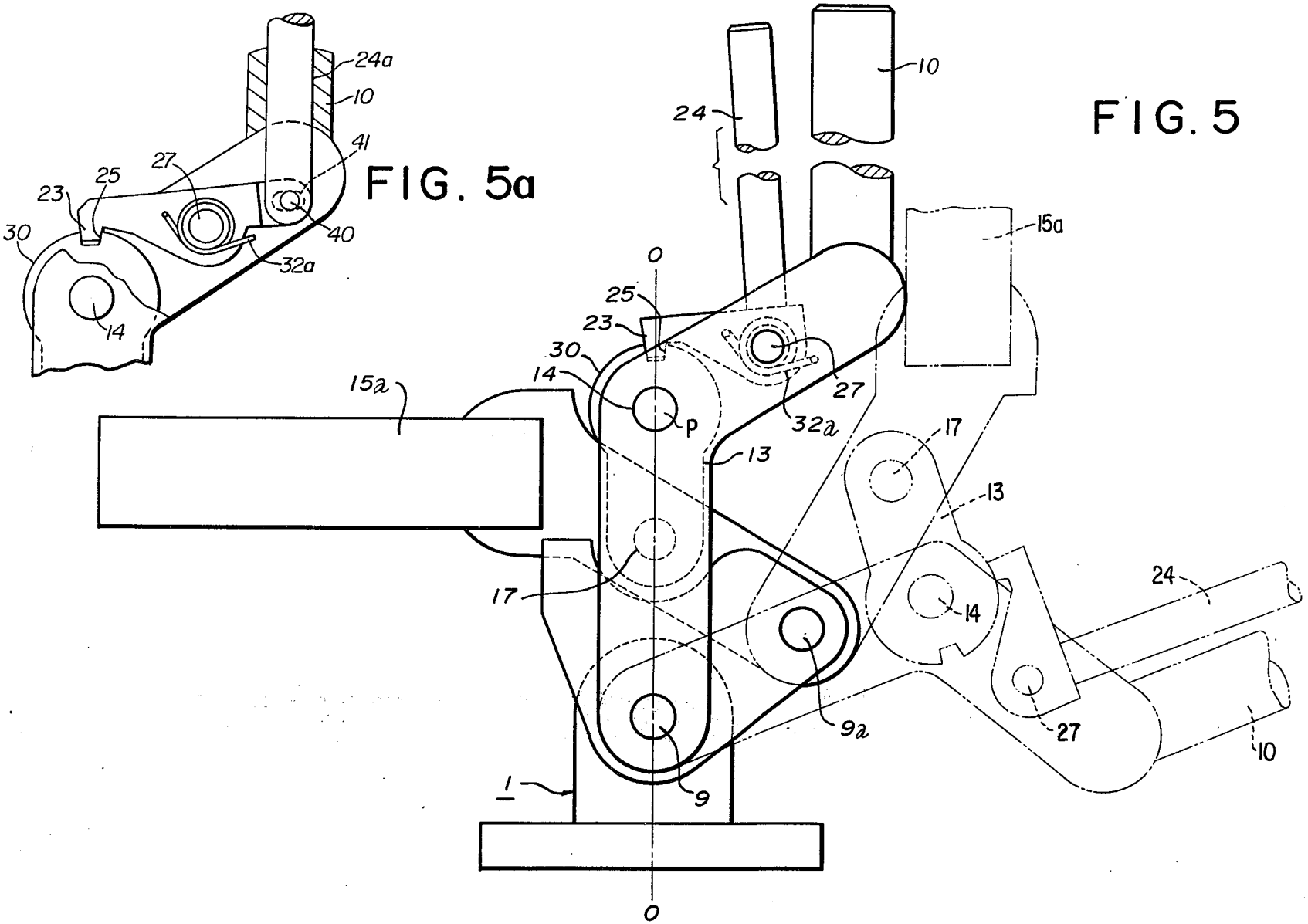
FIG. 5 is a side elevational view of a third embodiment.

FIG. 5*a* shows a partially modified construction of FIG. 5.

Figure 6:
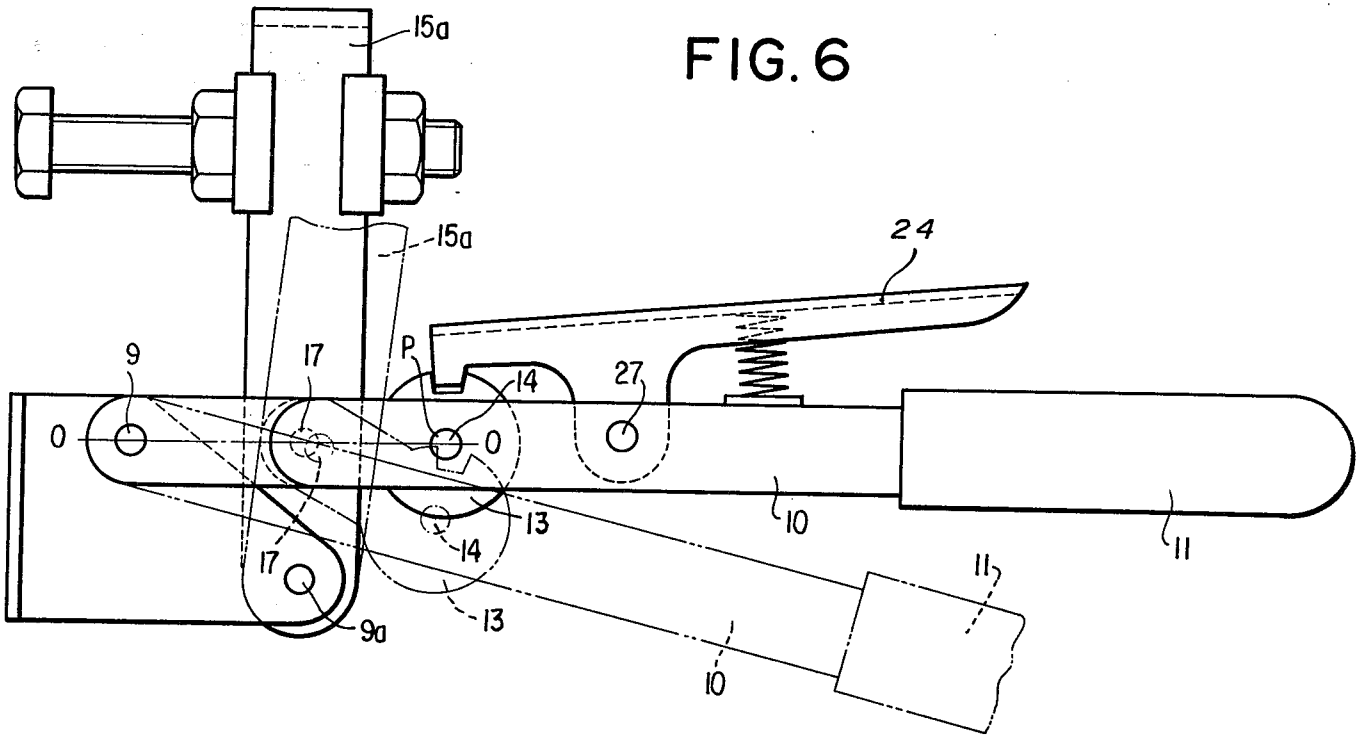
Figure 7:
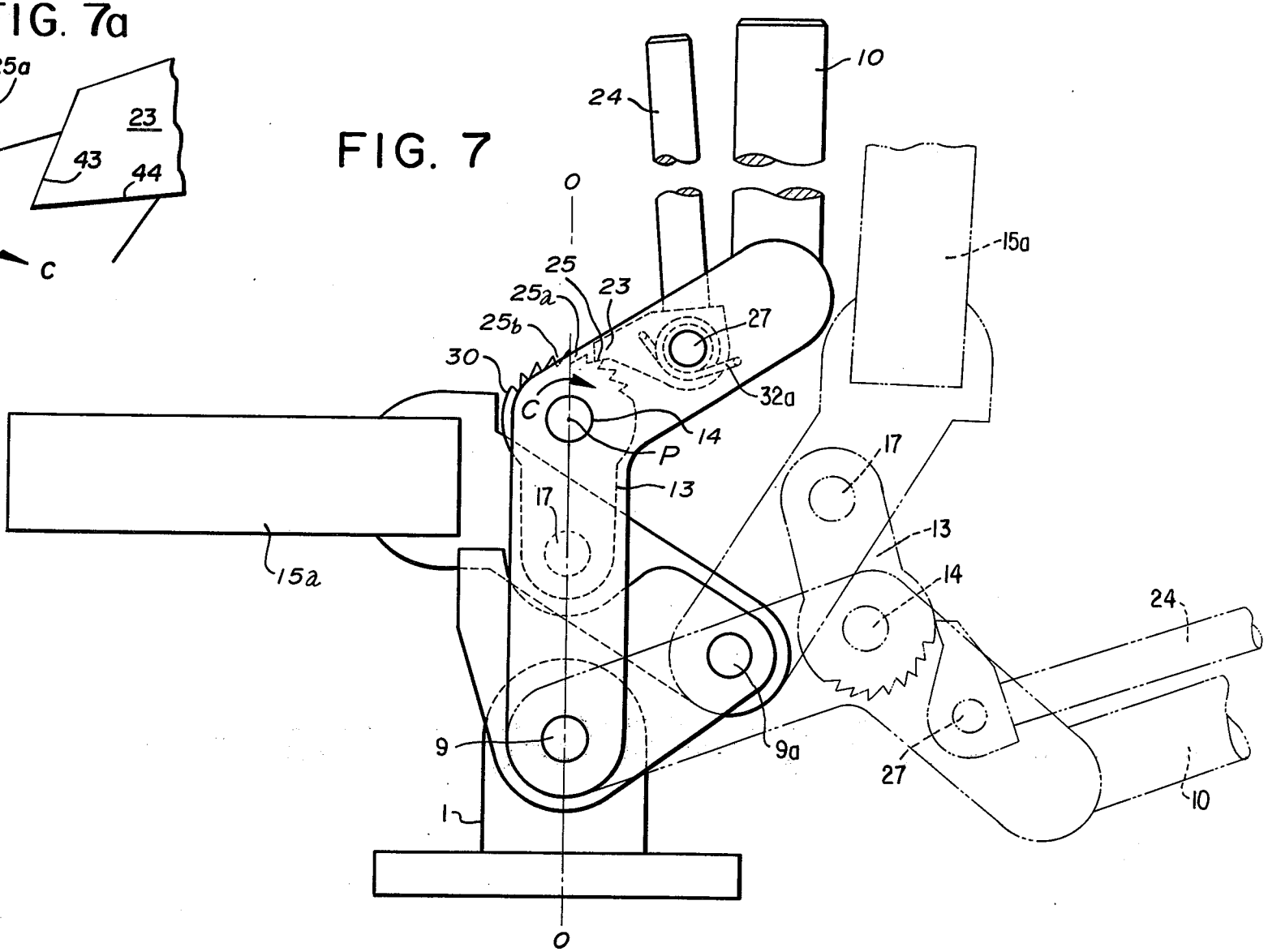
Figure 7A:
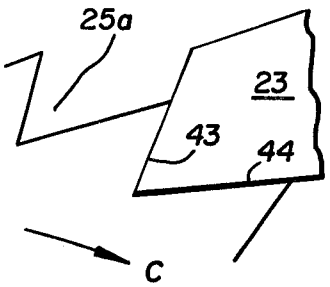

FIG. 6 is a side elevational view of a fourth embodiment of the invention;

FIG. 7 is a side elevational view of the modification shown in FIG. 5 showing a modified means for locking the toggle linkage in place; and FIG. 7*a* shows an enlarged detail of the modification shown in FIG. 7.

In each of the Figures the clamped and locked position of the toggle clamp device is shown in full lines and the released position is shown in phantom lines and similar elements in the Figures have similar reference numerals.

Figures 1, 1A, 2:
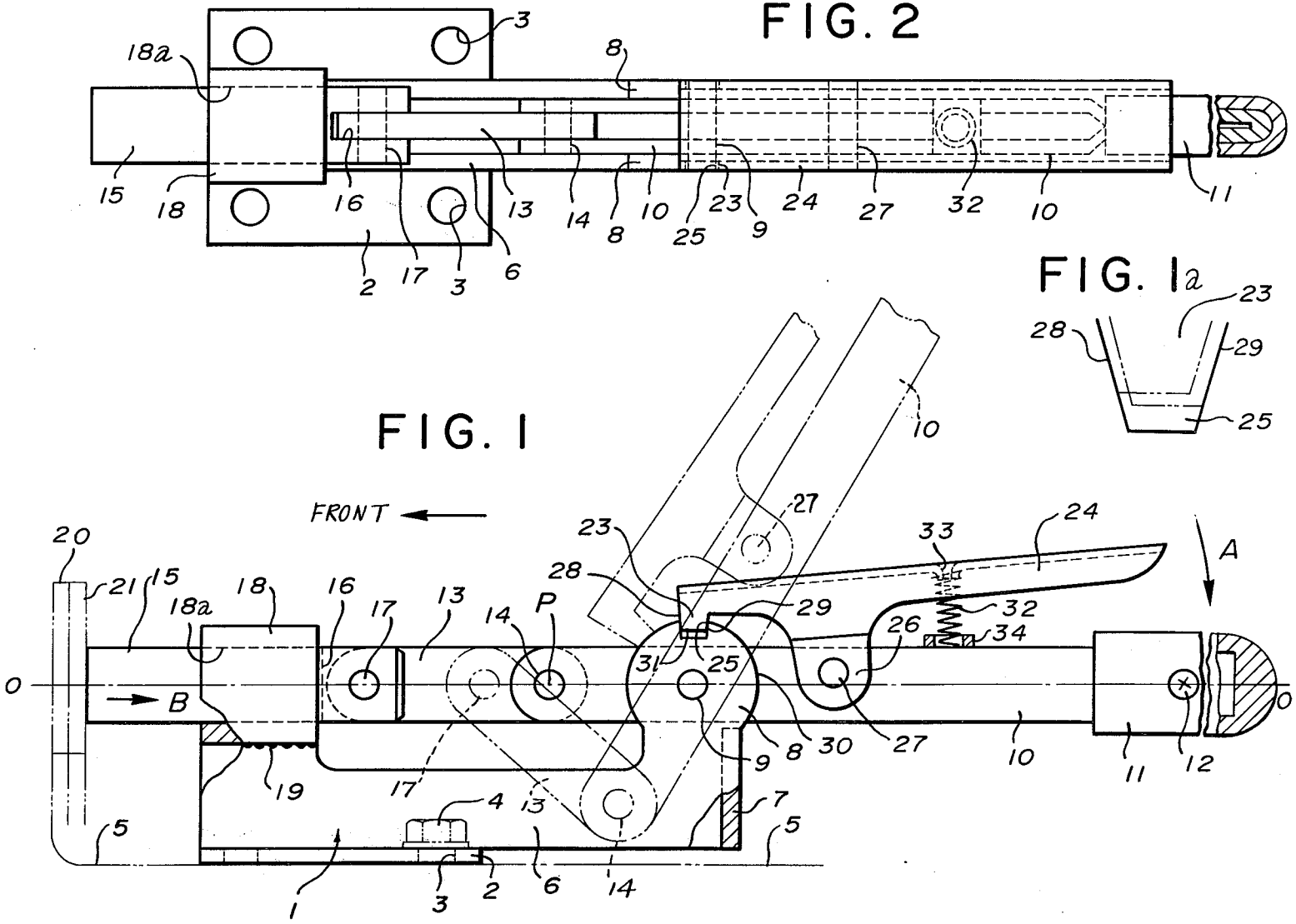
FIG. 2 is a plan view of the toggle clamp shown in FIG. 1.
Figure 4:
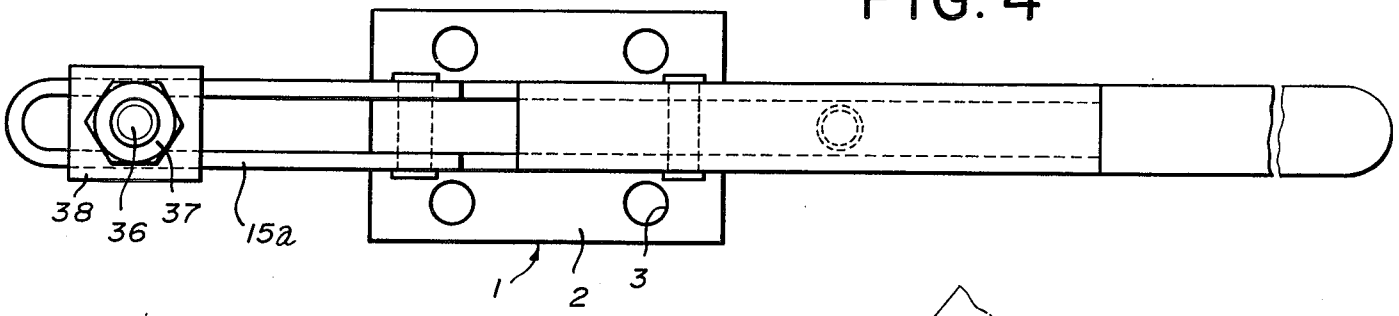
FIG. 4 is a plan view of FIG. 3.

In FIG. 1 and FIG. 2, a base bracket 1 which is formed from steel plate, provides an integral horizontal flange 2 at the bottom, a bolt 4 is passed through a hole 3 drilled in the horizontal flange 2, and a bolt 4 secures a jig 5 thereto, so that the base bracket 2 is fixed to the jig 5. In order to permanently fix the bracket 1 to the jig 5, a rivet can be used in place of the bolt 4 or the bracket 1 can be welded directly to the jig 5. Side walls 6, 6 rise vertically from both sides of the horizontal flange 2 and are connected to each other through a rear wall 7. A handle 10 is pivotally mounted on disc-like parts 8 projecting upward from the rear end portion (right hand side of FIG. 1) of the side wall 6 by a fixing pin 9 provided between the disc-like parts 8 and 8 (see FIG. 2).

The handle 10 shown in FIG. 1 is U-shaped in cross-section. A sheath-like grip 11 made of hard resin or the like is put on the right end of the handle in FIG. 1, and fixed to the handle 10 with a screw 12. A link 13 is mounted on a first movable pin 14 held between the arms of the handle 10 at the left end of handle 10 as shown in FIG. 1. The axis of the first movable pin 14 is parallel with the axis of fixing pin 9. The left end of the link 13 is fitted in a slot 16 provided on one end of a work pressing rod 15 having a round cross-section, and is connected thereto by means of a second movable pin 17 which is also parallel with the fixing pin 9. A bush 18 provided with a hole 18*a* for receiving the rod 15 is welded as at 19 to the side wall 6 of the bracket 1. 20 and 21 represent two work pieces which it is desired to keep in a fixed positional relationship with each other, and are clamped between the jig 5 and rod 15.

That part of the handle 10 between the fixing pin 9 and the first movable pin 14 corresponds to the above-mentioned first link of the toggle joint, and the link 13 corresponds to the above-mentioned second link. The point P is the dead point where a neutral line 0—0 connects the centers of the fixing pin 9, the second movable pin 17 and the first movable pin 14 as shown in full lines in FIG. 1. In order to securely hold the center of the first movable pin 14 on the dead point P when clamping the workpieces 20 and 21 by the rod 15, a lever 24 having a claw 23 which cooperates with a notch 25 in the disc-like parts 8—8 are provided. The lever 24 has a U-shaped section, and flanges 26 and 26 thereof projecting downward on either side, engage the outer side faces of the handle 10. The lever 24 is mounted on the handle 10 by a pin 27, and the claw 23 is provided in the same plane as the side flanges 26. The front edge and rear edge 28 and 29 of claw 23 are tapered as shown in FIG. 1*a* toward the fixing pin 9 so as to approach each other at the outer end of the claw 23. The claw 23 is urged to mesh closely with the notch 25 provided on the outer peripheral surface 30 of the disc-like parts 8, by means of the force of a compression spring 32. The front edge and rear edge of the notch 25 are also tapered to suitably mesh with the front and rear edges 28 and 29 of the claw 23, and the dimensions of the claw 23 and the notch 25 are previously determined so as to always produce a clearance between the end face 31 of the claw 23 and the bottom of the notch 25 even when the claw 23 and the notch 25 mesh with each other completely as shown in the figure. 33 is an inwardly directed cylindrical flange formed in the lever 24 and engages one end of the spring 32. 34 is a ring welded to the upper face of the handle 10 for engaging the other end of spring 32. The notch 25 is provided with front and rear edges 28 and 29 which closely contact with the front and rear edges of the claw 23 when the first movable pin 14 is situated at the dead point P on the neutral line 0—0.

The lever shown by full lines in FIG. 1 indicates the clamped condition. In order to release this condition, the lever 24 is moved in the direction shown by arrow A against the spring force of the spring 32, to disengage the claw 23 from the notch 25.

The handle 10 is then lifted to turn on the fixing pin 9, and the work pressing rod 15 moves in the direction of the arrow B by the movement of the first link, the first movable pin 14, link 13, and second movable pin 17, to the position shown in dotted lines in FIG. 1 and the workpieces are released. When the handle 10 reaches the raised position, the end face 31 of claw 23 is urged against the outer peripheral surface 30 by the spring 32, and the handle will stay in the raised position.

In order to set other workpieces 20 and 21 in place in relation to the jig 5 and clamp them against the jig 5, the handle 10 is turned in the direction of arrow A around the fixing pin 9, then the first movable pin 14 will be gradually raised close to the neutral line 0—0 and thus push the rod 15 through the link 13 in the reverse direction of the arrow B to apply a clamping force to the workpieces 20 and 21. In this way the maximum force is applied on the workpieces 20 and 21 in accordance with the principle of toggle mechanism when the center of the first movable pin 14 is situated just at the dead point P, and in this instance the claw 23 which has been sliding on the cylindrical surface meshes with the notch 25. At the moment when the first movable pin 14 thus reaches the dead point P to develop the maximum force, the handle 10 will be locked against the base bracket 1. Consequently, the following preferable results can be expected.

1. Because the center of the first movable pin 14 is held at the dead point P when clamping the workpieces, the maximum clamping force is obtainable to eliminate the possibility of loosening of the workpieces 20 and 21 during machine work or spot welding work applied thereon.

2. Because the locked position of the first movable pin 14 is unchanged when clamping the work, a locked position of the tip end of the rod 15 can be determined correctly to provide a maximum work clamping force.

3. Because the handle 10 is locked by the claw 23, notch 25 and spring 32 when clamping the workpieces, there is no possibility that the first movable pin 14 situated on the dead point P can deviate from the neutral line 0—0, even when vibration and shock are applied to the toggle clamp, thus eliminating the disadvantages caused by loosening or release of the rod 15.

4. Because the moment when the maximum force is generated can be determined by sound or hand feeling through the meshing of the notch 25 and the claw 23 which has been sliding on the cylindrical surface 30 by merely turning the handle in the direction of arrow A when clamping the work, the operation becomes very easy. The lever 24 provided on the handle 10, can be grasped simultaneously when grasping the handle 10 to turn the handle 10 in the reverse direction of the arrow A after permitting the claw 23 to be disengaged from the notch 25 when unclamping the work. Since an operating force for turning the handle 10 shown by full lines in the reverse direction of arrow A becomes smaller, the unclamping operation becomes simple and easy.

The tapers provided on the front and rear edges of the claw 23 and those on front and rear edges of the notch 25, corresponding to the claw 23, make it possible to apply the required clamping force on the workpieces 20 and 21 with a part of the front edge 28 of the claw being meshed with the front edge of the notch 25, and further make it possible to maintain a clamping condition merely by meshing the claw front edge 28, even when the total thickness of the workpieces 20 and 21 is a little larger or smaller than a standard value, so as to enlarge the scope of application of the toggle clamp in accordance with this invention. Even when the center of the first movable pin 14 moves a little beyond the dead point P when an operational force greater than required is applied by the handle 10 and the rear edge 29 of the claw meshes partially with the rear edge of the notch 25 as shown in FIG. 1*a*, the claw 23 will gradually mesh with the notch 25 by the force of the spring 32, the vibrational shock applied to the toggle clamp, and wedge action of the claw 23 etc. to automatically reach the optimum position shown in FIG. 1 in which the claw 23 completely meshes with the notch 25.

Figure 3:
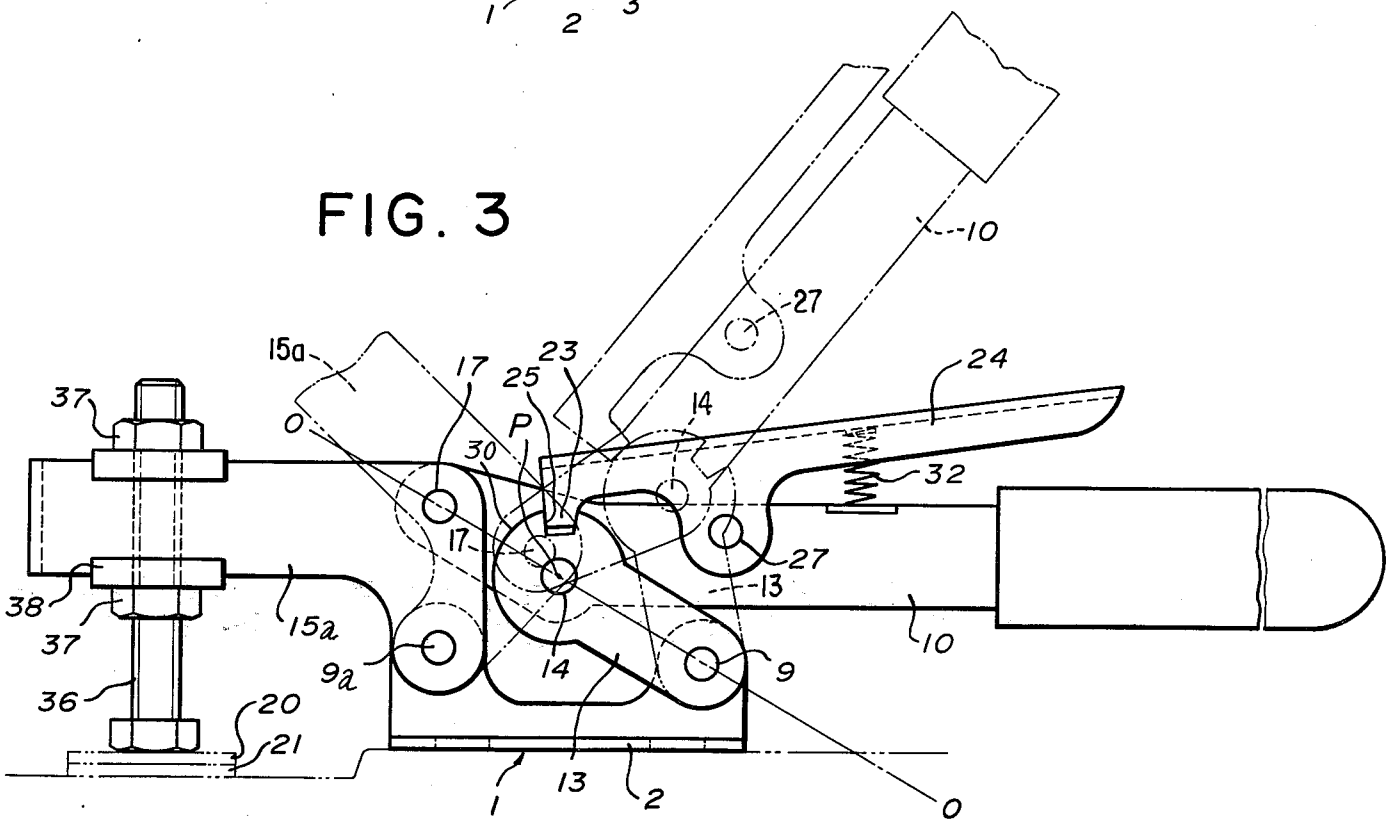
FIG. 3 is a side elevational view showing another embodiment.

FIGS. 3, 5 and 6 show various different embodiments of toggle joints in which the same reference numerals as shown in FIG. 1 indicate the corresponding part thereof. A work pressing arm 15*a* in FIG. 3 is pivotally mounted on the base bracket 1 by a second fixing pin 9*a*, and has an adjustable bolt 36 at the end thereof. 37 is an upper or lower lock nut and 38 is a washer. With regard to the toggle joint as illustrated in FIG. 3, a link 13 corresponds to the first link of FIG. 1, that portion of handle 10 between the first and second movable pins 14 and 17 corresponds to the second link 13 of FIG. 1, and the point P becomes the dead point when the line 0—0 connects the centers of a first fixing pin 9, the second movable pin 17 and the first movable pin 14, so that the arm 15*a* applies the maximum clamping force on the workpieces 20 and 21 through the adjustable bolt 36 in the position illustrated in full lines in FIG. 3. The clamp is so designed that a claw 23 meshes with a notch 25 provided on the link 13 just at this moment.

In the toggle clamp shown in FIG. 5 that portion of handle 10 between a first fixing pin 9 and a first movable pin 14 corresponds to the first link of FIG. 1 and the link 13 corresponds to the second link of FIG. 1. An arm 15*a* is supported by a second fixing pin 9*a*, while the bottom end of the link 13 is connected thereto by a second movable pin 17, and the claw is so designed as to mesh with a notch 25 provided on the link 13 when the center of the first movable pin 14 lies on the line 0—0 connecting the first fixing pin 9 and second movable pin 17. 32*a* is a torsional coil spring mounted on a pin 27, the ends thereof being connected to the claw 23 and handle 10 respectively, thus giving the claw 23 a spring force always urging it against the cylindrical surface 30 of link 13.

A push rod 24*a* as shown in FIG. 5*a* can be employed in place of the lever 24 in FIG. 5. The push rod 24*a* fits in a hole in the handle 10 and partially projects therefrom, thus the claw 23 can be disengaged from the notch 25 by pushing the end of the push rod 24*a* with the thumb when operating the handle 10. 40 is a pin parallel with the pin 27, and 41 is a slot provided in the body of the claw 23 for receiving the pin 40.

In the toggle clamp as shown in FIG. 6, the toggle joint is of the type shown in FIG. 5 and the lever 24 of the type shown in FIG. 1 and FIG. 3.

A toggle clamp of FIG. 7 has substantially the same construction as that of FIG. 5, except that a plurality of ratchet-teeth 25, 25*a* and 25*b* are provided, in place of notch 25, on the cylindrical surface 30 of the link 13. Each tooth or notch provides a stopping surface 43 (FIG. 7*a*) which extends radially from the center of the first movable pin 14 and an inclined surface 44 which engages the claw 23 in order to prevent the link 13 from turning around the first movable pin 14 in the direction C. Further, the notch 25*a* of FIG. 7 will mesh with the claw 23 when the center of the first movable pin 14 coincides with the dead point P on the line 0—0, i.e. when the arm 15*a* reaches a position where it generates the maximum output. On the cylindrical surface 30 there are provided additional notches 25*a*, 25*b*, etc. In this way it becomes possible to apply a required clamping force on the workpieces by meshing the claw 23 with the notch 25*a* or 25*b* when the thicknesses of the workpieces differ from each other and especially when the total thickness thereof is larger than a standard value.

Although the present invention has been shown and described with reference to the attached drawings, the scope of this invention is limited only by the attached claims.

What is claimed is:

1. A toggle clamp device for locking work-pieces in a fixed position comprising a base bracket having at least one fixed pin thereon, means for clamping the workpieces together, a handle member mounted for movement relative to said fixed pin, a toggle linkage including a movable link actuated by said handle member and provided with a first pin movable with said link, said clamping means having a second pin movable by said link when said link is moved by said handle member, said clamping means being movable, in response to continuous, one directional movement of said handle member, from a position of less than maximum clamping force to a position of maximum clamping force and then to a portion of less than maximum clamping force, said clamping means being in the position of maximum clamping force when said fixed pin, said first movable pin and said second movable pin are in linear alignment with one another, and comprising a biased claw means pivotally mounted on said handle member, one element of said toggle device being provided with a notch for receiving said claw means when the clamping means are in the clamping position and the fixed pin and first and second movable pins are in linear alignment.

2. A toggle clamp device as claimed in claim 1 wherein said claw means includes a claw, and at least one side of said claw and the at least one corresponding side of said notch have mating tapered configurations for facilitating complete engagement thereof as the movable pins approach alignment with the fixed pin to obtain maximum clamping force.

3. A toggle clamp device for locking workpieces in a fixed position of maximum clamping force comprising a base bracket having a fixed pin thereon, means for clamping the workpieces together, a handle member mounted for movement about said fixed pin, a toggle linkage including a first link mounted on said fixed pin and movable by said handle member and provided with a first movable pin, a second link mounted on said first movable pin and provided with a second movable pin, said first movable pin being connected to said handle member and said second movable pin being connected to said clamping means, whereby the maximum clamping force is applied to said clamping means when said fixed pin, said first movable pin and said second movable pin are moved into linear alignment by movement of said handle member, a claw means mounted on said handle element and means for operating said claw means, said base bracket being provided with a notch for engagement by said claw means when maximum clamping force is applied.

4. A toggle clamp device as claimed in claim 3 wherein said handle member is mounted intermediate its ends on said fixed pin and said base bracket is provided with a hole normal to the axis of said fixed pin, said clamping means including a rod slidably mounted in said hole, said first movable pin being connected to one end of said handle member and the second movable pin being connected to the rear end of said slidably mounted rod, the axes of said movable pins being parallel to the axis of said fixed pin.

5. A toggle clamp device as claimed in claim 4 wherein said claw means includes a lever pivotally mounted on said handle member about an axis parallel to said fixed pin, one end of said lever being provided with a claw, said base bracket being provided with a cylindrical surface about the axis of said fixed pin against which said claw slides when said claw and notch are disengaged and said claw means further includes a biasing means for urging said claw to bear against said cylindrical surface when disengaged from said notch.

6. A toggle clamp device for locking workpieces in a fixed position comprising a base bracket having at least one fixed pin thereon, means for clamping the workpieces together, a handle member mounted for movement relative to the fixed pin, a toggle linkage including a movable link actuated by the handle member and provided with a first pin movable with the link, the clamping means having a second pin movable by the link when the link is moved by the handle member, the clamping means being in a position of maximum clamping force when the fixed pin, the movable pin and the second movable pin are in linear alignment with one another, and comprising a biased claw means including a lever pivotally mounted on the handle member about an axis parallel to the fixed pin, one end of the lever being provided with a claw, one element of the toggle device being provided with a notch for receiving the claw when the clamping means are in the clamping position and the fixed pin and first and second movable pins are in alignment, the claw means further including a biasing means for urging the claw into the notch, with at least one side of the claw and at least one corresponding side of the notch having mating tapered configurations for facilitating complete engagement thereof as the movable pins approach alignment with the fixed pin to obtain maximum clamping.

7. A toggle clamp device for locking workpieces in a fixed position of maximum clamping force comprising a base bracket having a fixed pin thereon, means for clamping the workpieces together, a handle member mounted for movement about said fixed pin, a toggle linkage including a first link mounted on the fixed pin and movable by the handle member and provided with a first movable pin, a second link mounted on the first movable pin and provided with a second movable pin, the first movable pin being connected to the handle member and the second movable pin being connected to the clamping means, whereby the maximum clamping force is applied to the clamping means when the fixed pin, the first movable pin and the second movable pin are moved into linear alignment by movement of said handle member, a claw means including a lever pivotally mounted on the handle member about an axis parallel to the fixed pin, one end of the lever being provided with a claw, at least one side of the claw and at least one corresponding side of the notch having mating tapered configurations for facilitating complete engagement thereof as the movable pins approach alignment with the fixed pin to obtain maximum clamping force, the claw means further including a biasing means for urging the claw into the notch.

* * * * *